US011832079B2

(12) United States Patent
Von Turckheim et al.

(10) Patent No.: US 11,832,079 B2
(45) Date of Patent: Nov. 28, 2023

(54) SYSTEM AND METHOD FOR PROVIDING STEREO IMAGE ENHANCEMENT OF A MULTI-CHANNEL LOUDSPEAKER SETUP

(71) Applicant: Harman Becker Automotive Systems GmbH, Karlsbad (DE)

(72) Inventors: Friedrich Von Turckheim, Hamburg (DE); Stefan Finauer, Munich (DE); Adrian von dem Knesebeck, Munich (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 17/688,231

(22) Filed: Mar. 7, 2022

(65) Prior Publication Data

US 2022/0322020 A1 Oct. 6, 2022

Related U.S. Application Data

(60) Provisional application No. 63/167,952, filed on Mar. 30, 2021.

(51) Int. Cl.

| | |
|---|---|
| ***H04S 7/00*** | (2006.01) |
| ***G10L 19/008*** | (2013.01) |
| ***H04R 5/02*** | (2006.01) |
| ***H04S 3/00*** | (2006.01) |
| ***H04R 5/04*** | (2006.01) |

(52) U.S. Cl.

CPC ..... *H04S 7/30* (2013.01); *G10L 19/008* (2013.01); *H04R 5/02* (2013.01); *H04R 5/04* (2013.01); *H04S 3/008* (2013.01); *H04S 2400/01* (2013.01); *H04S 2400/05* (2013.01); *H04S 2400/13* (2013.01)

(58) Field of Classification Search

CPC ..... G10L 19/008; G10L 19/02; H04R 5/02; H04R 2499/13

USPC ..... 381/106, 303, 302, 23, 107; 700/94

See application file for complete search history.

(56) References Cited

U.S. PATENT DOCUMENTS

| | | | | |
|---|---|---|---|---|
| 9,983,847 | B2 | 5/2018 | Lakkundi et al. | |
| 2015/0194158 | A1* | 7/2015 | Oh | G10L 19/008 381/22 |
| 2021/0112340 | A1* | 4/2021 | Seldess | G10L 19/008 |

* cited by examiner

*Primary Examiner* — Alexander Krzystan

(74) *Attorney, Agent, or Firm* — Brooks Kushman P.C.

(57) ABSTRACT

In at least one embodiment, an audio system is provided. At least one controller is programmed to encode a first and second audio component and to generate a first and a second encoded audio component. The at least one controller is programmed to apply a first gain to at least one of the first encoded audio component and the second encoded audio component to generate at least one of a first and second increased encoded audio component and to decode the at least one of the first and the second increased encoded audio component to generate at least one of a first and second decoded audio component. The at least one controller is further programmed to amplitude pan the at least one of the first and the second decoded audio component to increase a stereo width for an audio output transmitted by a first loudspeaker and a second loudspeaker.

20 Claims, 6 Drawing Sheets

SYSTEM AND METHOD FOR PROVIDING STEREO IMAGE ENHANCEMENT OF A MULTI-CHANNEL LOUDSPEAKER SETUP

CROSS-REFERENCE TO RELATED APPLICATIONS

This application claims the benefit of U.S. provisional application Ser. No. 63/167,952 filed Mar. 30, 2021, the disclosure of which is hereby incorporated in its entirety by reference herein.

TECHNICAL FIELD

Aspects disclosed herein generally relate to an apparatus and method for providing stereo image enhancement of a multi-channel loudspeaker setup in accordance with one aspect. In one example, the apparatus and method for providing the stereo image enhancement of the multi-channel loudspeaker setup may be performed via mono and side audio decoding and amplitude panning. These aspects and others will be discussed in more detail below.

BACKGROUND

Stereo widening is generally required if an available loudspeaker setup is insufficient to reproduce a satisfactory stereo width and proper image/stage. For devices with small loudspeaker dimensions, for example, such as laptops or mobile devices, stereo widening helps to achieve sufficient stereo perception despite the small dimensions. Stereo widening may also improve the stereo distribution in larger playback systems. In asymmetrical listening situations, such as in a vehicle, a problem or issue generally arises when the listener is positioned too close to one of the loudspeakers and the stereo width is unnaturally narrow.

SUMMARY

In at least one embodiment, an audio system for providing stereo image enhancement for a multi-channel loudspeaker is provided. The audio system includes memory and at least one controller. The at least one controller includes the memory and is programmed to receive an audio input including a first audio component and a second audio component from an audio playback device and to encode the first audio component and the second audio component to generate a first encoded audio component and a second encoded audio component. The at least one controller is programmed to apply a first gain to at least one of the first encoded audio component and the second encoded audio component to generate at least one of a first increased encoded audio component and a second increased encoded audio component and to decode the at least one of the first increased encoded audio component and the second increased encoded audio component to generate at least one of a first decoded audio component and a second decoded audio component. The at least one controller is further programmed to amplitude pan the at least one of the first decoded audio component and the second decoded audio component to increase a stereo width for an audio output signal transmitted by a first loudspeaker and a second loudspeaker.

In at least one embodiment, a method for providing stereo image enhancement for a multi-channel loudspeaker is provided. The method includes transmitting an audio output signal in a listening environment via a first loudspeaker and a second loudspeaker and receiving an audio input including a first audio component and a second audio component from an audio playback device. The method further includes encoding the first audio component and the second audio component to generate a first encoded audio component and a second encoded audio component and applying a first gain to at least one of the first encoded audio component and the second encoded audio component to generate at least one of a first increased encoded audio component and a second increased encoded audio component. The method further includes decoding the at least one of the first increased encoded audio component and the second increased encoded audio component to generate at least one of a first decoded audio component and a second decoded audio component and amplitude panning the at least one of the first decoded audio component and the second decoded audio component to increase a stereo width for the audio output signal transmitted by the first loudspeaker and the second loudspeaker.

In at least one embodiment, a computer-program product embodied in a non-transitory computer readable medium that is programmed for providing stereo image enhancement for a multi-channel loudspeaker is provided. The computer-program product includes instructions for receiving an audio input including a first audio component and a second audio component from an audio playback device and encoding the first audio component and the second audio component to generate a first encoded audio component and a second encoded audio component. The computer-program product includes instructions for applying a first gain to at least one of the first encoded audio component and the second encoded audio component to generate at least one of a first increased encoded audio component and a second increased encoded audio component and decoding the at least one of the first increased encoded audio component and the second increased encoded audio component to generate at least one of a first decoded audio component and a second decoded audio component. The computer-program product includes instructions for amplitude panning the at least one of the first decoded audio component and the second decoded audio component to increase a stereo width for an audio output signal transmitted by a first loudspeaker and a second loudspeaker.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 1:
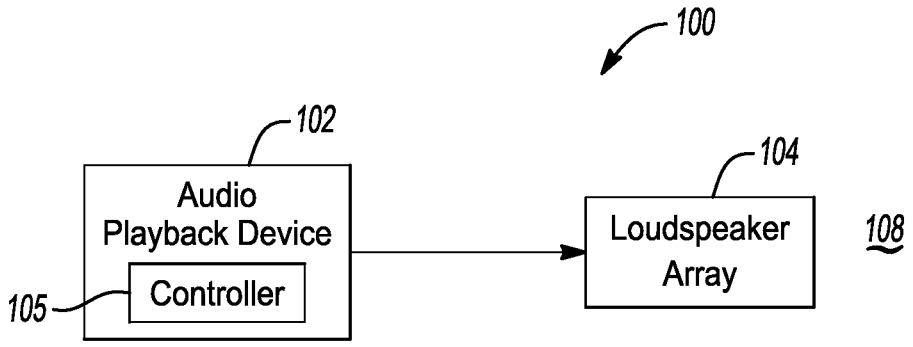
FIG. 1 depicts a system for providing a stereo image enhancement of a multi-channel loudspeaker setup in accordance with one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that the controllers as disclosed herein may include various microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, such controllers as disclosed utilizes one or more microprocessors to execute a computer-program that is embodied in a non-transitory computer readable medium that is programmed to perform any number of the functions as disclosed. Further, the controller(s) as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware-based inputs and outputs for receiving and transmitting data, respectively from and to other hardware-based devices as discussed herein.

Stereo widening may be necessary if the available loudspeaker setup is insufficient to reproduce a satisfactory stereo width and proper image/stage. For devices with small loudspeaker dimensions, for example, laptops or mobile devices, stereo widening helps to achieve sufficient stereo perception despite the small dimensions. Stereo widening may also improve the stereo distribution in larger playback systems. In asymmetrical listening situations, such as in a vehicle, a problem that may occur is when the listener is too close to one of the loudspeakers and the stereo width is unnaturally narrow. Aspects disclosed herein enables a stereo base to be expanded beyond the physical distance of the loudspeakers positioned in a listening environment. Additionally, aspects disclosed herein enables the position of a phantom (or virtual) center loudspeaker to be adjusted (or moved) in an asymmetrical listening position. In this case, a proper and stable stereo and stage imaging audio experience may be achieved.

Aspects disclosed herein may also provide various processing operations such as splitting up a stereo signal into a side signal (or part) (e.g., de-correlated content) and a mono signal (or part) (e.g., correlated content) and using amplitude panning to shift the side signal to rear loudspeakers while the mono signal is panned to a phantom (or virtual) center loudspeaker. In this case, the widening effect can be applied to outer signal parts (or outer side signals) only (e.g., instruments that are panned to the left or right or decorrelated signal content like reverberation, etc.) while the center content (or mono content) may be kept stable (e.g., the solo instrument, mono speaker or singer, etc.). With this aspect, it is possible to emphasize reverberation and side-panned content to draw attention toward the stereo content. The center image stability may be controlled by the level of the mono signal. In addition, the position of the phantom center may be modified which may be useful for asymmetric listening positions such as in a vehicle. Compared to stereo widening implementations that are based on de-correlation and correlated audio signals, the aspects provided herein may avoid comb-filtering artifacts, smearing of the stereo image and incorrect localization of the phantom center.

The stereo content (or stereo audio signal) may be divided into two parts, a stereo part and a mono part. The stereo part and mono part may be the only two channels that can be weighted differently. Once these channels are encoded and then later decoded prior to being transmitted from a loudspeaker, the decoded signal is translated into a left/right signal, which is performed by using the two parts (e.g., stereo and mono) together. However, it is possible to use the mono part separately and either run the mono part in a separate (third) channel or to merge the mono part with the stereo part in such a way that the mono content (correlated part) is no longer perceived in the middle, but off center, for example, further to the left. The transformation from left/right into mono/stereo parts is a lossless transformation and represents a different (two-channel) representation of the signal.

The aspects disclosed herein may provide the following: (1) a stable and adjustable phantom center position, (2) less comb filtering and phasing artifacts compared to conventional stereo widening implementations, (3) improved widening effect for larger loudspeaker setups (e.g., vehicle, HiFi, etc.); (4) the possible re-use of existing audio processing objects; and (5) low machine instructions per second (MIPS)/micro-electro-mechanical (MEM) footprint. It is recognized that a minimum 4-channel loudspeaker setup may be used in connection with the system and method described herein.

FIG. 1 depicts a system 100 for stereo image enhancement of a multi-channel loudspeaker setup in accordance with one embodiment. The system 100 includes an audio playback device 102 and a loudspeaker array 104. The audio playback device 102 is configured to transmit one or more audio signals to the loudspeaker array 104 for playback of audio in a listening environment 108. In one example, the listening environment 108 may be an interior cabin of a vehicle, a room of a residence or other establishment in which users gather to listen to audio. The audio playback device 102 may be a media player embedded in an instrument panel of a vehicle. In another example, the audio playback device 102 may be a tablet, mobile device, laptop, etc.

The loudspeaker array 104 generally includes a plurality of loudspeakers 104*a*-104*d* (see FIG. 2) that are positioned about the listening environment 108. The audio playback device 102 includes at least one controller 105 (hereafter "the controller 105) that is configured to perform any number of the operations disclosed herein. The audio playback device 102 is generally configured to transmit the audio signals to the loudspeaker array 104 for stereo playback in the listening environment 108. Assuming the listening environment 108 corresponds to the vehicle cabin, the loudspeakers 104*a*-104*d* may be situated about the vehicle cabin. For example, the loudspeaker 104*a* may be a front left loudspeaker in the vehicle, the loudspeaker 104*b* may be a front right loudspeaker in the vehicle, the loudspeaker 104*c* may be a rear left loudspeaker in the vehicle, and the loudspeaker 104*d* may be a rear right loudspeaker in the vehicle. The loudspeakers 104*a*-104*d* are distributed about a polar coordinate system. Each point on a plane is determined by a distance from a reference point and at an angle from a reference direction. A listener 109 is depicted as being located in a center of the polar coordinate system.

Figure 2:
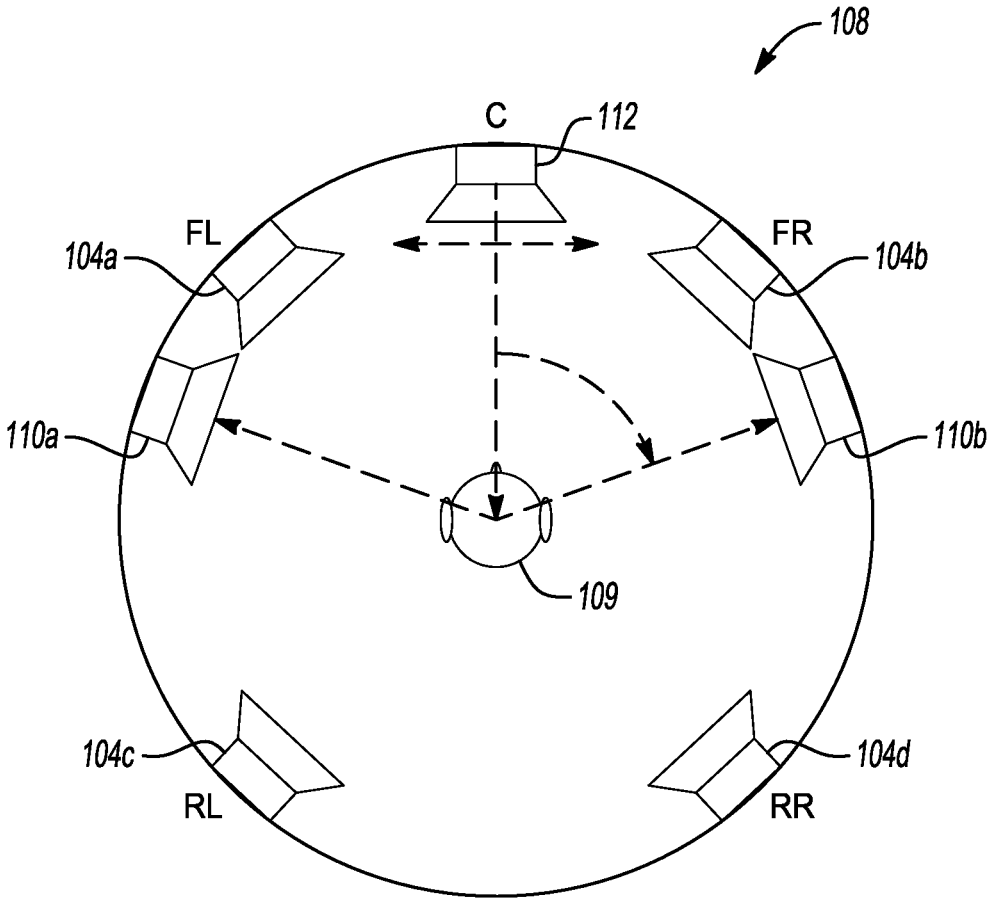
FIG. 2 depicts a system of physical loudspeakers and virtual loudspeakers as being positioned about or around a listener in a listening environment in accordance with one embodiment.

Referring now to FIGS. 1 and 2, the controller 105 may increase or widen a stereo image of the audio transmitted of the loudspeakers 104*a* and 104*b* by establishing a first virtual loudspeaker 110*a* and a second virtual loudspeaker 110*b*, respectively. In general, the controller 105 may create a stereo image in which the listener 109 in the listening environment 108 perceives the audio being transmitted by the loudspeakers 104*a* and 104*b* to have a wider stereo audio image (by generating the first virtual loudspeaker 110*a* and the second virtual loudspeaker 110*b*). The controller 105 may also generate a phantom (or virtual) center loudspeaker 112. In this case, the first virtual loudspeaker 110*a* and the second virtual loudspeaker 110*b* transmit audio data on a left channel and a right channel, respectively, and the phantom (or virtual) loudspeaker 112) transmits the audio data on a center channel in a stereo audio format. In one example, the controller 105 may increase the amount of reverberation on the left channel and the right channel transmitted from the front left loudspeaker 104*a* and from the front right-loudspeaker 104*b*, respectively, to increase the perceived width of the stereo image provided by the loudspeaker array 104.

Figure 3:
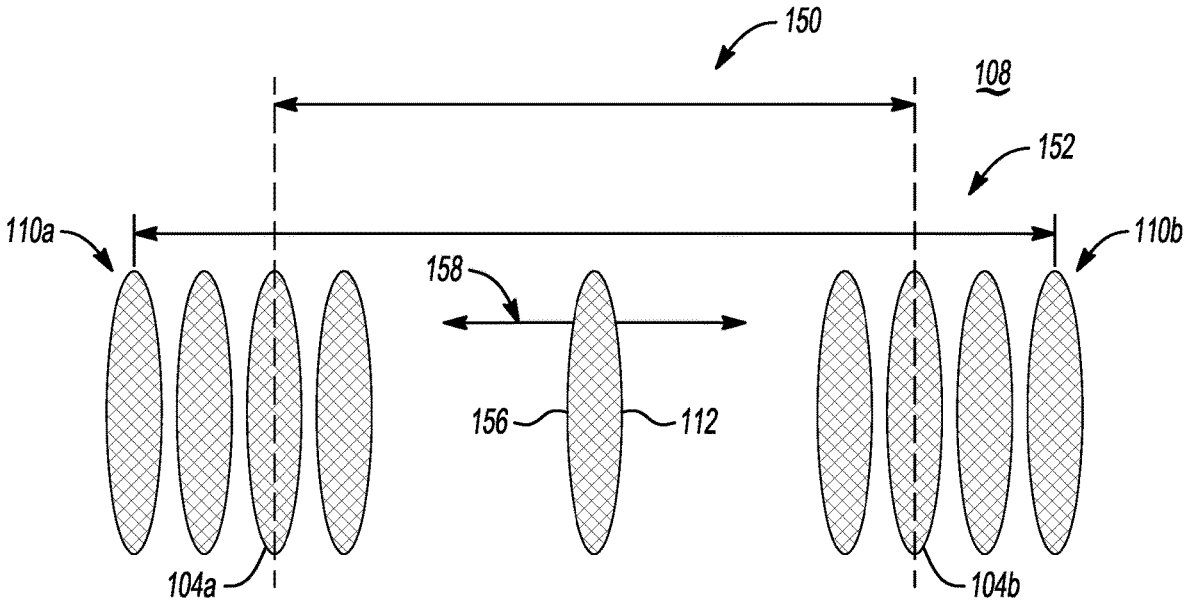
FIG. 3 depicts an actual width for the physical loudspeakers and a perceived width for the physical loudspeakers along with a phantom loudspeaker positioned in a center of the listening environment in accordance with one embodiment.

FIG. 3 depicts an actual width 150 at which the physical loudspeakers 104*a*, 104*b* transmit the audio data and a perceived width 152 for the first and second virtual loudspeakers 110*a*, 110*b*. FIG. 3 also depicts a position 156 of the phantom (or virtual) center loudspeaker 112. The controller 105 generates the phantom (or virtual) center loudspeaker 112 at the position 156 along a first axis 158 along with a phantom loudspeaker positioned in a center of the listening environment 108. The controller 105 generates the phantom center loudspeaker 112 and may position the phantom center loudspeaker 112 on any position or spot 156 on the first axis 158. The physical loudspeakers 104*a*, 104*b* (e.g., the first and the second virtual loudspeakers 110*a*, 110*b*) transmit uncorrelated audio content such as for example, audio data on the left and right channels into the listening environment 108. The phantom center loudspeaker 112 transmits correlated audio content, for example, on a center channel into the listening environment 108.

Figure 4:
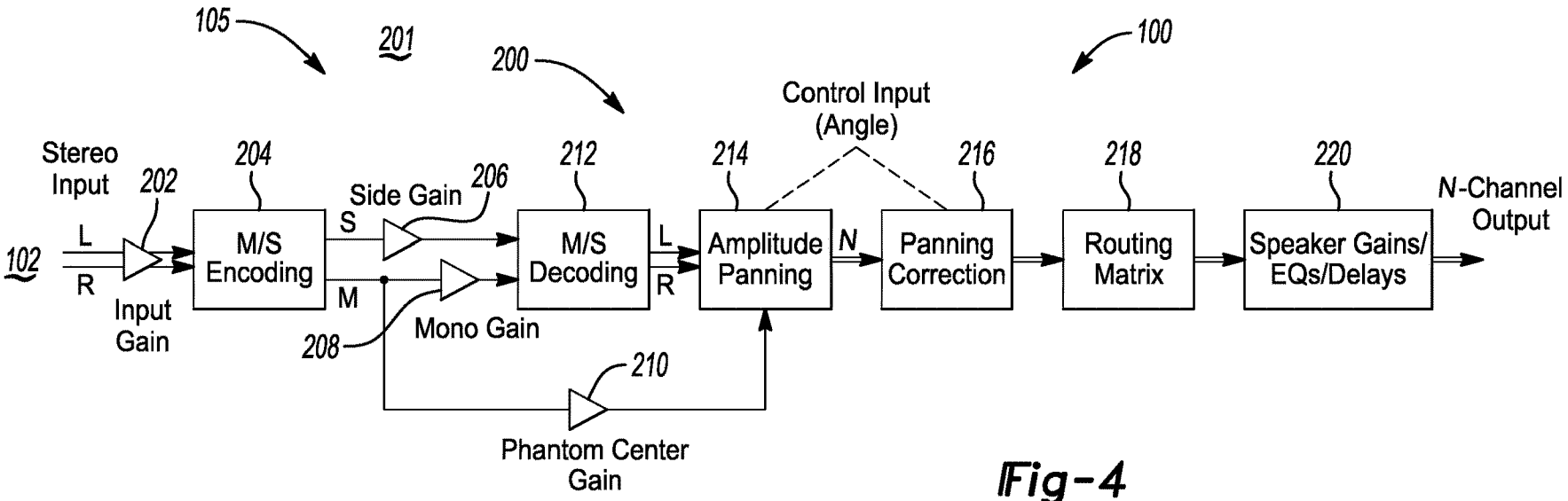
FIG. 4 depicts a more detailed implementation of a controller in the system for providing a stereo image enhancement of multi-channel loudspeaker setup in accordance with one embodiment.

FIG. 4 depicts a more detailed implementation of controller 105 in the system 100 for providing a stereo image enhancement of multi-channel loudspeaker setup in accordance with one embodiment. The controller 105 includes an input gain block 202, a mono and side (M/S) encoding block 204, a side gain block 206, a mono gain block 208, a phantom center gain block 210, an M/S decoding block 212, an amplitude panning block 214, a panning correction block 216, a routing matrix 218, and a speaker gain/EQ/delay block 220 (e.g., or speaker parameters block 220). The controller 105 also includes memory 201 to store instructions to execute the operations noted herein. The audio playback device 102 provides the audio data in the form of left audio data (L) and right audio data (R) to the input gain block 202 which increases the gain (or loudness thereof).

The M/S encoding block 204 generates mono audio (M) and side audio (S) based on the left audio data (L) and the right audio data (R). For example, the M/S encoding block 204 adds the left audio data (L) to the right audio data (R) to generate the mono audio (M) that is output therefrom. Similarly, the M/S encoding block 204 subtracts the left audio data (L) from the mono output to generate side audio data (S). It is recognized that instead of M/S processing, other processing techniques may include or be added to M/S processing which includes shuffling. The side gain block 206 applies a gain to the side audio (S) as output from the M/S encoding block 204. The mono gain block 208 applies a gain to the mono audio (M). It is recognized that the mono gain block 208 may apply small or low gain to the mono audio (M) (i.e., almost a unity gain). It is also recognized that the mono gain block 208 may also decrease the loudness of the mono audio (M) if the gain block 208 is set to a fraction. The amount of gain applied by the mono gain block 208 may vary based on the desired criteria of a particular implementation. The side gain block 206 applies a gain (e.g., a large gain) to the side audio (S) to increase the loudness of the side audio (S). In another example, the controller 105 may adjust a frequency response of the output from the side gain block 206 prior to being received at the M/S decoding block 212 to obtain or increase the side or stereo perception. Additionally, the phantom center gain block 210 applies a gain to the mono audio (M) that is independent of the gain applied to the mono audio (M) from the mono gain block 208. In this case, the phantom center gain block 210 may apply a larger gain than that applied by the mono gain block 208 to provide for an independent mono audio (M) that bypasses the M/S decoding block 212. The phantom center gain block 210 increases the loudness of the mono audio (M) which is fed to the amplitude panning block 214.

The M/S decoding block 212 decodes the increased side audio (S) (e.g., as provided by the side gain block 206) and decodes the mono audio (M) as output by the mono gain block 208. The M/S decoding block 212 then generates left audio data (L) and the right audio data (R) based on the increased side audio (S) and the mono audio (M). The left audio data (L) and the right audio data (R) as generated by the M/S decoding block 212 is increased given that such data is based on an increase to the side audio (S) by the side gain block 206.

The M/S decoding block 212 generates the left audio data (L) by adding the mono audio (M) to the side audio (S). The M/S decoding block 212 generates the right audio data (R) by subtracting the side audio (S) from the mono audio (M). The amplitude panning block 214 receives the increased left audio data (L) and the increased right audio data (R) in addition to the increased mono audio (M) provided by the phantom center gain block 210. The amplitude panning block 214 applies amplitude panning to the increased left and right audio data (L) and (R) to shift such audio data to the rear loudspeakers 104*c* and 104*d* while the mono audio (M) provided by the phantom center gain block 210 is panned to provide the phantom center loudspeaker 112 at the position (or location) 156 along the first axis 158 to provide the center channel for the listener 108.

Amplitude panning generally corresponds to the amplitude (playback level) of an audio output from a loudspeaker 104 that changes based on an angle. A phantom source generally requires two loudspeakers (e.g., in our case loudspeakers 104*a* and 104*b*). If a mono sound source is played through the two loudspeakers 104*a* and 104*b* (e.g., both loudspeakers 104*a* and 104*b* play the same), the phantom sound source (or phantom center loudspeaker 112 is created, for example, in the middle, between the two loudspeakers 104*a* and 104*b*. If the playback level of one loudspeaker 104*a* is increased and that of the other loudspeaker 104*b* is reduced, the phantom center loudspeaker 112 moves in the direction toward the louder loudspeaker (e.g., the loudspeaker 104*a*). Amplitude panning generally entails that one can place a sound source between the speakers by changing the playback level of two speakers. This may be accomplished with a mono center signal or with a stereo signal (for example the left channel).

A control input angle is provided to the amplitude panning block 214 to adjust an angle of audio transmission for the front left loudspeaker 104*a* and the front right loudspeaker 104*b*, respectively. Due to the amplitude panning as employed herein, an engineer (or end user) has the ability to input the control input angle (via a user interface that is either positioned on the audio playback device 102 or on another controller in communication with the audio playback device 102). Such a control angle enables the user to specify the exact degree on the polar coordinate at which the phantom center loudspeaker 112 transmits a center channel audio signal. If the signal that is normally only played from one loudspeaker (for example the left stereo channel from the left front loudspeaker 104*a*) is played through two loudspeakers (for example from the left front and left rear loudspeakers 104*a* and 104*c*), it appears as a phantom sound source (or phantom center loudspeaker 112) between the two loudspeakers 104*a* and 104*b*. In the example as set forth herein, the left stereo signal detaches from the position of the physical loudspeaker (front left) 104*a* and moves towards the rear left loudspeaker 104*c*. This increases the stereo width, and the left "end" of the stereo image moves further to the left and to the rear. Due to the amplitude panning method, the controller 105 enables the engineer to place the virtual speakers (or phantom sound sources) to the exact degree.

The panning correction block 216 enables an adjustment (e.g., linear increase or decrease) of the gain after the amplitude panning is performed. The routing matrix 218 defines which audio is transmitted to the various loudspeakers 104*a*-104*d* (e.g., right/left and front/rear). In theory, amplitude panning algorithms match the perceived position of a sound source. In practice, however, this may not be the case, since the listening room adds reflections or the loudspeakers 104*a*-104*d* do not have an optimal transfer function or are not placed at the same distance from the listener 108. As a result, a sound source that is supposed to come from 30°, for example, is not perceived at this location. The panning correction block 216 may compensate for this condition. For example, such compensation may occur by adjusting the level of the two loudspeakers 104*a*-104*d* at 30°. The controller 105 is therefore dynamically adapted to the set angle (e.g., angle control input). For example, the controller 105 may include gains, delays or digital filters that act based on the angle and compensate for the perceived localization problems. The speaker parameters block 220 adjusts or balances the spectral behavior of the audio output for the loudspeakers 104*a*-104*d*.

Figure 5:
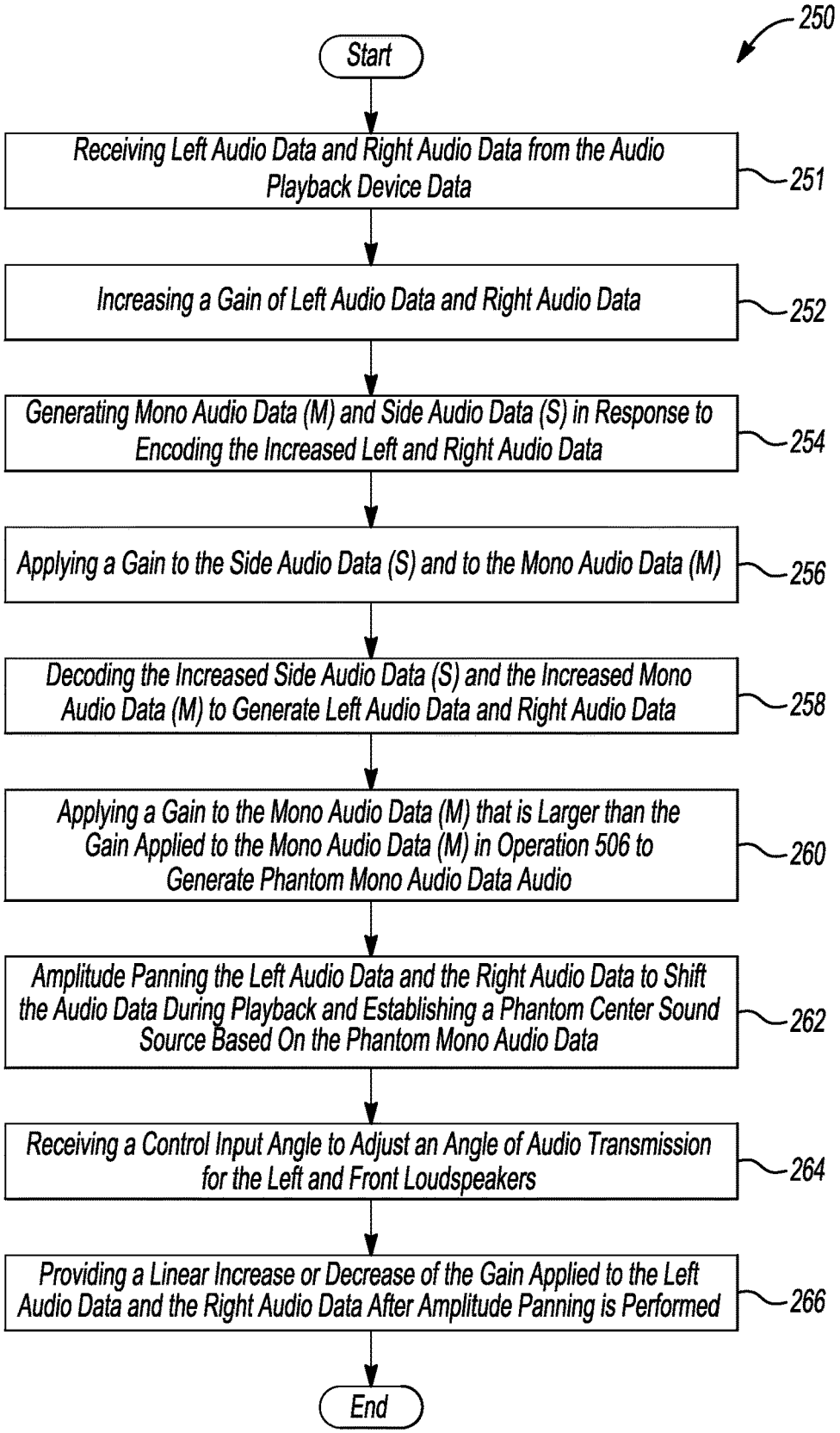
FIG. 5 depicts a method for providing a stereo image enhancement of a multi-channel loudspeaker setup in accordance with one embodiment.

FIG. 5 depicts a method 250 for providing the stereo image enhancement of the multi-channel loudspeaker setup in accordance with one embodiment.

In operation 251, the controller 105 receive left audio data (L) (e.g., a first audio component) and right audio data (R) (e.g., a second audio component) from the audio playback device.

In operation 252, the controller 105 increases a gain (or loudness) of left audio data (L) and right audio data (R) as received from the audio playback device 102.

In operation 254, the controller 105 generates mono audio data (M) and side audio data (S) based on the increased gain of the left audio data (L) and the right audio data (R). For example, the controller 105 encodes the left audio data (L) and the right audio data (R). By encoding, the controller 105 adds the left audio data (L) to the right audio data (R) to generate the mono audio data (M) (e.g., a first encoded audio component). Further, by encoding, the controller 105 subtracts the left audio data (L) from the mono audio data (M) to generate side audio data (S) (e.g., a first encoded audio component).

In operation 256, the controller 105 applies a gain to the mono audio data (M) and to the side audio data (S) to generate an increased mono audio data (M) and an increased side audio data (S).

In operation 258, the controller 105 decodes the increased side audio data (S) and decodes the increased mono audio data (M). The M/S decoding block 212 then generates the left audio data (L) and the right audio data (R) based on the increased side audio data (S) and the increased mono audio data (M). The controller 105 generates the left audio data (L) by adding the increased mono audio data (M) to the side audio data (S). The controller 105 generates the right audio data (R) by subtracting the increased side audio data (S) from the increased mono audio data (M).

In operation 260, the controller 105 applies a gain only to the mono audio data (M) that is larger than the gain applied in operation 256 to generate phantom mono audio data (M).

In operation 262, the controller 105 performs amplitude panning to the left audio data (L) and the right audio data (R) to shift an audio output signal during playback and establishing the phantom center sound source 112 (or the phantom (or virtual) center loudspeaker 112).

In operation 264, the controller 105 receives the control input (or control angle) to adjust an angle of audio transmission for the left and right loudspeakers 104*a* and 104*b*. The control angle also enables the user to specify the exact degree on the polar coordinate at which the phantom center loudspeaker 112 transmits a center channel audio signal.

In operation 266, the controller 105 provides an adjustment (e.g., linear increase or decrease) of the gain applied to the audio output after the amplitude panning is performed.

Figure 6:
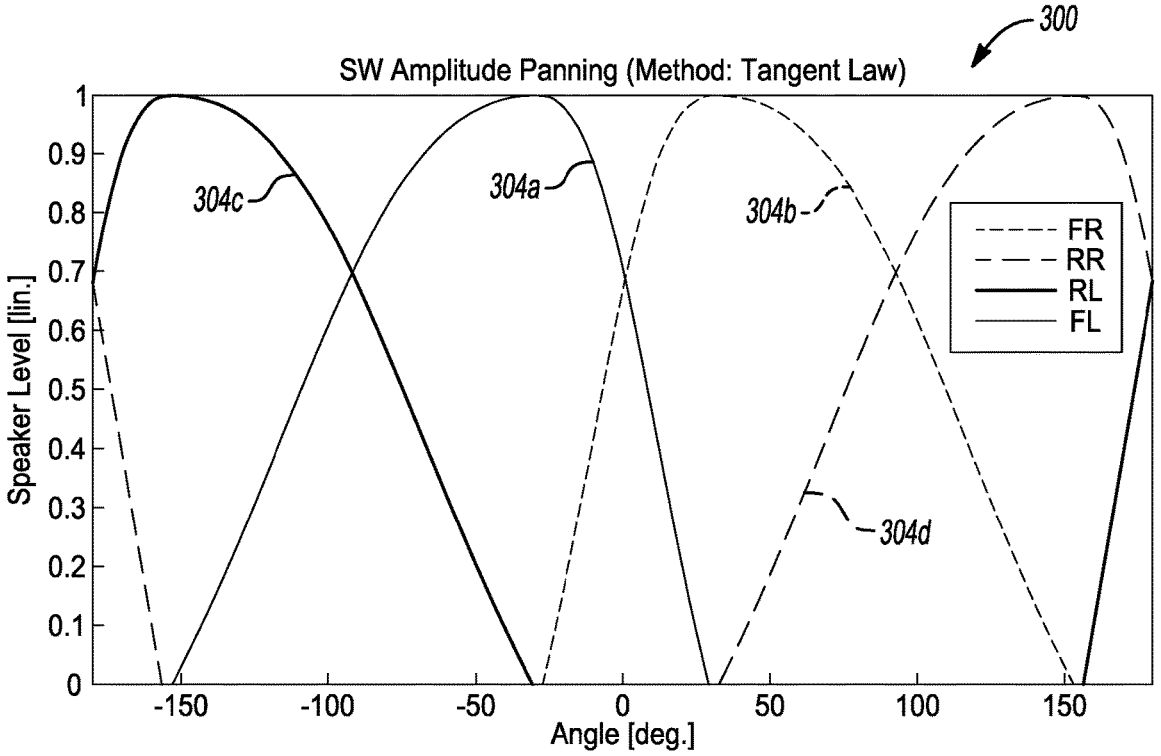
FIG. 6 depicts a plot of amplitude panning for a front right loudspeaker, a rear right loudspeaker, a front left loudspeaker, and a rear left loudspeaker in accordance with one embodiment.

FIG. 6 is a plot 300 that illustrates various control angles (see x-axis) that may be used in connection with the loudspeakers 104*a*-104*d* and various speaker levels for the loudspeakers 104*a*-104*d*. The plot 300 provides a waveform 304*a* that illustrates respective control angles and speaker levels for the front left loudspeaker 104*a*. The plot 300 provides waveform 304*b* that illustrates respective control angles and speaker levels for the front right loudspeaker 104*b*. The plot 300 provides waveform 304*c* that illustrates respective control angles and speaker levels for the rear left loudspeaker 104*c*. The plot 300 provides waveform 304*d* that illustrates respective control angles for speaker levels for the rear right loudspeaker 104*d*. As shown, the control angles for the left loudspeakers (e.g., front left loudspeaker 104*a* and rear left loudspeaker 104*c*) have negative values and the control angles for the right loudspeakers (e.g., front right loudspeaker 104*b* and the rear right loudspeakers 104*c*) have positive values.

In the event the control angle is set to roughly −80 degrees, such a control angle enables both the front left loudspeaker 104*a* and the rear loudspeaker 104*c* to provide a loudspeaker level (or linear amplitude) of 0.7. In the event the control angle is set to roughly −50 degrees, such a control angle enables the front left loudspeaker 104*a* to provide a loudspeaker level of 0.96 (or close to 1.0) and the rear left loudspeaker 104*c* to provide a loudspeaker level of close to 0.2. In the event the control angle is set to roughly +80 degrees, such a control angle enables both the front right loudspeaker 104*b* and the rear right loudspeaker 104*d* to provide a loudspeaker level of 0.7. In the event the control angle is set to roughly +50 degrees, such a control angle enables the front right loudspeaker 104*b* to provide a loudspeaker level of 0.96 (or close to 1.0) and the rear right loudspeaker 104*d* to provide a loudspeaker level of close to 0.2. It is recognized that an audio engineer may configure or set the control angles after tuning the audio system. However, in other embodiments, a user interface may be provided to enable users to adjust the degree of stereo widening to suit his/her audio playback preferences.

The plot 300 of FIG. 6 corresponds to a display having a center line axis for projecting audio into the listening environment and corresponding angles for the front left loudspeaker, the front right loudspeaker, the rear right loudspeaker, and the rear left loudspeaker in accordance with one embodiment. The display illustrates amplitude vectors which will be discussed below.

Figure 7:
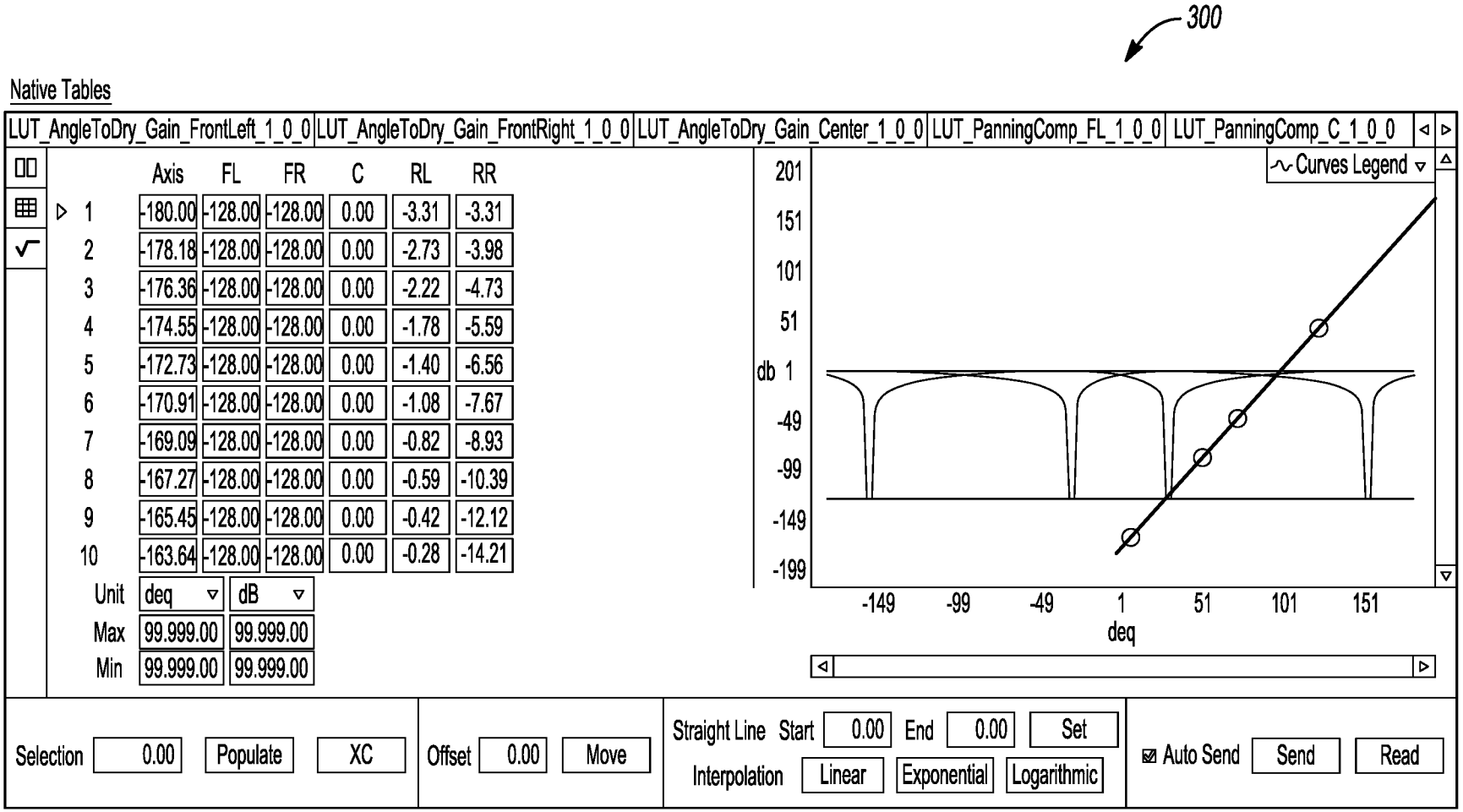
FIG. 7 depicts a display having a center line axis for projecting audio into the listening environment and corresponding angles for the front left loudspeaker, the front right loudspeaker, the rear right loudspeaker, and the rear left loudspeaker in accordance with one embodiment.
Figure 8:
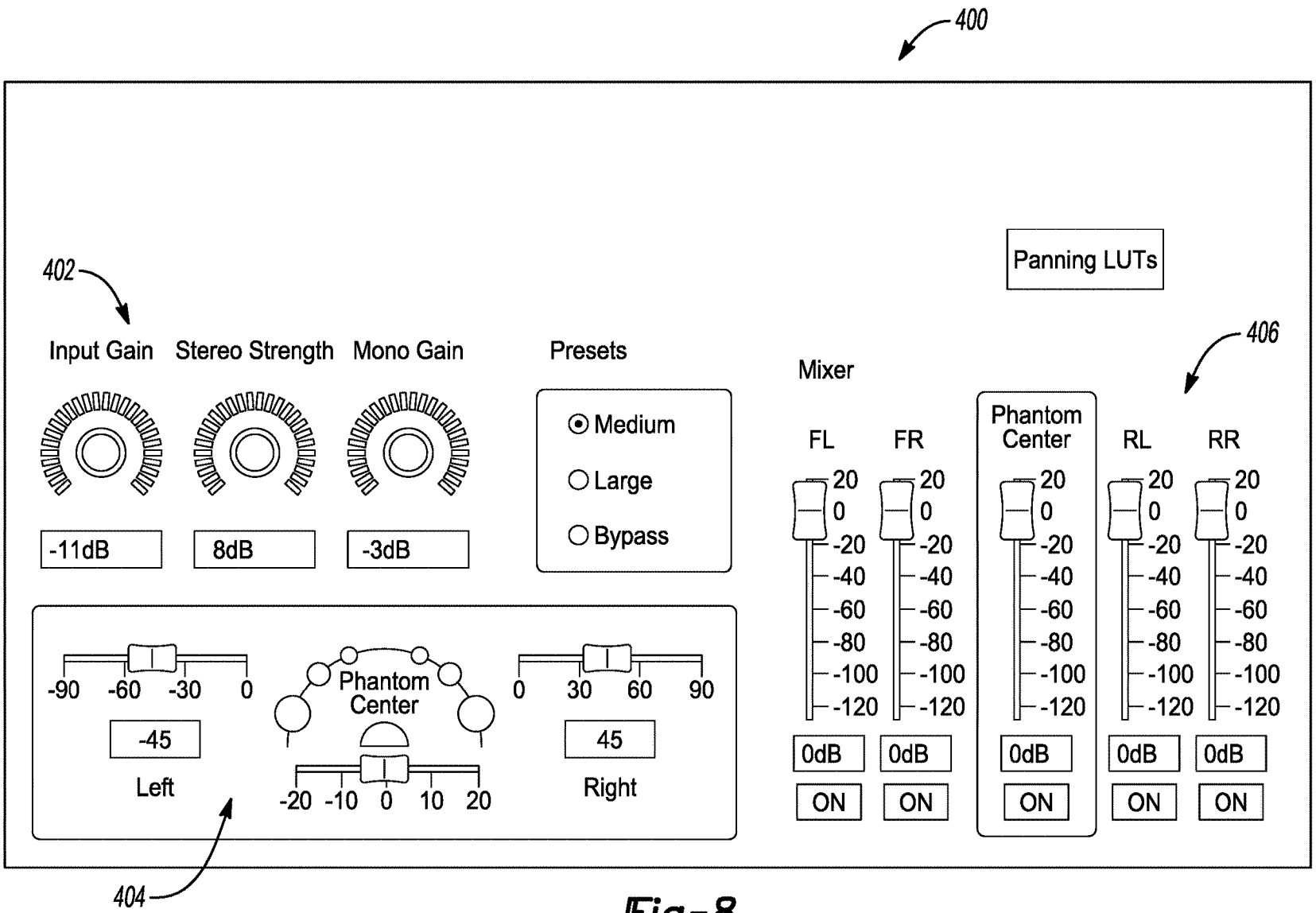
FIG. 8 depicts a user interface that enables a listener to control the stereo widening characteristics for a loudspeaker array within a listening environment based on the aspects disclosed herein.

FIG. 7 depicts a user interface 400 that enables a listener to control the stereo widening characteristics for the loudspeaker array 104 within the listening environment 108 in accordance with the embodiments disclosed herein. The user interface 400 includes a first set of controls 402, a second set of controls 404, and a third set of controls 406. The first set of controls 402 includes an input gain, a stereo strength, a mono gain, and presets. The input gain controls the stereo input gain (e.g., may be software processing). The stereo strength provides a gain of the side (or de-correlated) content. The mono gain controls the gain of mono (or correlated) content. The presets enable different tuning sets (e.g., medium and large) and a bypass mode.

The second set of controls 404 includes a left loudspeaker control, a phantom center control, and a right loudspeaker control. The left loudspeaker control controls panning of a left M/S encoded signal (e.g., may be limited to −90 . . . 0 degrees). The right loudspeaker control controls panning of a right M/S encoded signal (e.g., may be limited to 0 . . . +90 degrees). The phantom center control controls a shift of a phantom center (e.g., may be limited to +/−20 degrees).

The third set of controls 406 includes a mixer and panning look up tables (LUTs). The mixer controls the output gain of physical loudspeakers and a phantom center. The panning LUTs opens LUTs including amplitude vectors. The LUTs include amplitude vectors and define amplitude values that are to be calculated at each corresponding angle. It is also recognized that real-time calculations may be performed in determining the amplitude vectors for corresponding control angles.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An audio system for providing stereo image enhancement for a multi-channel loudspeaker, the audio system comprising:

memory; and at least one controller including the memory and being programmed to:

receive an audio input including a first audio component and a second audio component from an audio playback device;

encode the first audio component and the second audio component to generate a first encoded audio component and a second encoded audio component;

apply a first gain to at least one of the first encoded audio component and the second encoded audio component to generate at least one of a first increased encoded audio component and a second increased encoded audio component;

decode the at least one of the first increased encoded audio component and the second increased encoded audio component to generate at least one of a first decoded audio component and a second decoded audio component; and amplitude pan the at least one of the first decoded audio component and the second decoded audio component to increase a stereo width for an audio output signal transmitted by a first loudspeaker and a second loudspeaker.

2. The audio system of claim 1, wherein the at least one controller is further programmed to apply a second gain to the second increased encoded audio component that is larger than the first gain applied to the second increased encoded audio component to generate a phantom center audio component.

3. The audio system of claim 2, wherein the at least one controller is further programmed to amplitude pan at least the phantom center audio component to generate a virtual center loudspeaker.

4. The audio system of claim 3, wherein the virtual center loudspeaker is positioned on an axis between the first loudspeaker and the second loudspeaker.

5. The audio system of claim 1, wherein the at least one controller is further programmed to receive a control angle signal to adjust an angle of audio transmission of the audio output signal from the first loudspeaker and the second loudspeaker.

6. The audio system of claim 5, wherein the at least one controller is further programmed to adjust the angle of the audio transmission based on the control angle signal and in response to amplitude panning the at least one of the first decoded audio component and the second decoded audio component.

7. The audio system of claim 1, wherein the first audio component corresponds to left audio data and the second audio component corresponds to right audio data.

8. The audio system of claim 7, wherein the first encoded audio component corresponds to side audio data and the second audio component corresponds to mono audio data.

9. The audio system of claim 8, wherein the at least one controller is further programmed to subtract the left audio data from the mono audio data to generate the side audio data.

10. The audio system of claim 8, wherein the at least one controller is further programmed to add the left audio data to the right audio data to generate the mono audio data.

11. A method for providing stereo image enhancement for a multi-channel loudspeaker, the method comprising:

transmitting an audio output signal in a listening environment via a first loudspeaker and a second loudspeaker;

receiving an audio input including a first audio component and a second audio component from an audio playback device;

encoding the first audio component and the second audio component to generate a first encoded audio component and a second encoded audio component;

applying a first gain to at least one of the first encoded audio component and the second encoded audio component to generate at least one of a first increased encoded audio component and a second increased encoded audio component;

decoding the at least one of the first increased encoded audio component and the second increased encoded audio component to generate at least one of a first decoded audio component and a second decoded audio component; and amplitude panning the at least one of the first decoded audio component and the second decoded audio component to increase a stereo width for the audio output signal transmitted by the first loudspeaker and the second loudspeaker.

12. The method of claim 11 further comprising applying a second gain to the second increased encoded audio component that is larger than the first gain applied to the second increased encoded audio component to generate a phantom center audio component.

13. The method of claim 12 further comprising amplitude panning at least the phantom center audio component to generate a virtual center loudspeaker.

14. The method of claim 11 further comprising receiving a control angle signal to adjust an angle of audio transmission of the audio output signal from the first loudspeaker and the second loudspeaker.

15. The method of claim 14 further comprising adjusting the angle of the audio transmission based on the control angle signal and in response to amplitude panning the at least one of the first decoded audio component and the second decoded audio component.

16. The method of claim 11, wherein the first audio component corresponds to left audio data and the second audio component corresponds to right audio data.

17. The method of claim 16, wherein the first encoded audio component corresponds to side audio data and the second audio component corresponds to mono audio data.

18. The method of claim 17 further comprising subtracting the left audio data from the mono audio data to generate the side audio data.

19. The method of claim 17 further comprising adding the left audio data to the right audio data to generate the mono audio data.

20. A computer-program product embodied in a non-transitory computer readable medium that is programmed for providing stereo image enhancement for a multi-channel loudspeaker, the computer-program product comprising instructions for:

receiving an audio input including a first audio component and a second audio component from an audio playback device;

encoding the first audio component and the second audio component to generate a first encoded audio component and a second encoded audio component;

applying a first gain to at least one of the first encoded audio component and the second encoded audio component to generate at least one of a first increased encoded audio component and a second increased encoded audio component;

decoding the at least one of the first increased encoded audio component and the second increased encoded audio component to generate at least one of a first decoded audio component and a second decoded audio component; and amplitude panning the at least one of the first decoded audio component and the second decoded audio component to increase a stereo width for an audio output signal transmitted by a first loudspeaker and a second loudspeaker.

* * * * *